US005566635A

United States Patent [19]

Namur

[11] Patent Number: 5,566,635

[45] Date of Patent: Oct. 22, 1996

[54] TAILPIECE FOR THE FORKED BOOM OF A RIG FOR SURFBOARDS

[75] Inventor: Marc Namur, Weiterstadt, Germany

[73] Assignee: Fanatic Sports GmbH, Ransbach-Baumbach, Germany

[21] Appl. No.: 519,333

[22] Filed: Aug. 25, 1995

[30] Foreign Application Priority Data

Aug. 25, 1994 [DE] Germany ..... 9413579 U

[51] Int. Cl.[6] ..... B63B 15/00

[52] U.S. Cl. ..... 114/97; 114/39.2

[58] Field of Search ..... 114/39.2, 97, 98, 114/102

[56] References Cited

U.S. PATENT DOCUMENTS 4,436,047 3/1984 Freyrie ..... 114/39.2

5,239,938 8/1993 Spradley ..... 114/97

FOREIGN PATENT DOCUMENTS 8112417.1 9/1981 Germany .

3401821 7/1985 Germany .

*Primary Examiner*—Jesus D. Sotelo

*Attorney, Agent, or Firm*—Young & Thompson

[57] ABSTRACT

A tailpiece for a forked boom of a rig for surfboards, comprising a tube bend segment (9), carried by a tube bend (10) to which is fastened bars (3) of the forked boom. On the upper side of the tube bend segment (9) there is a plate (12) with a wide straight-through slit (13) for receiving a fastening ring (14) of the clew (8) of the sail (7). The bend segment (9) has a rear opening (15), and a spring-loaded latch (16) is exposed through this opening (15). A hook (17) on the latch (16) swivels in and out of the fastening ring (14) of the sail (7) under the influence of a spring (21).

8 Claims, 6 Drawing Sheets

9
10
12
21
15
18
4
19
13
a
b
17
16
14
11
3
7
8
3
11

TAILPIECE FOR THE FORKED BOOM OF A RIG FOR SURFBOARDS

The invention concerns a tailpiece for the forked boom of a rig for surfboards.

Usually the clew of the sail of a surfboard is tightened with a rope's end on the forked boom tailpiece.

Modern surfing technology is developing to the point of obtaining exact control and maneuvering of the surfboard through a stable, backlash-free fastening of the sail clew to the forked boom tailpiece and a tension-free sail leech. Trimming the sail is effected by lengthwise adjustment of a rope's end attached to the clew of the sail and to the forked boom tailpiece.

This modern surfing technology requires the development of a new forked boom tailpiece that makes possible a stable, backlash-free connection between the clew of the sail and the tailpiece.

The forked boom endpiece according to the invention fulfills—in an ideal way and through modern surfing technology—demands placed on the rig of a surfboard through a safe, quick, backlash-free fastening of the sail clew by means of a spring-loaded latch and offers, in addition, the possibility of fastening and trimming the sail in the traditional way with a rope's end.

Figure 1:
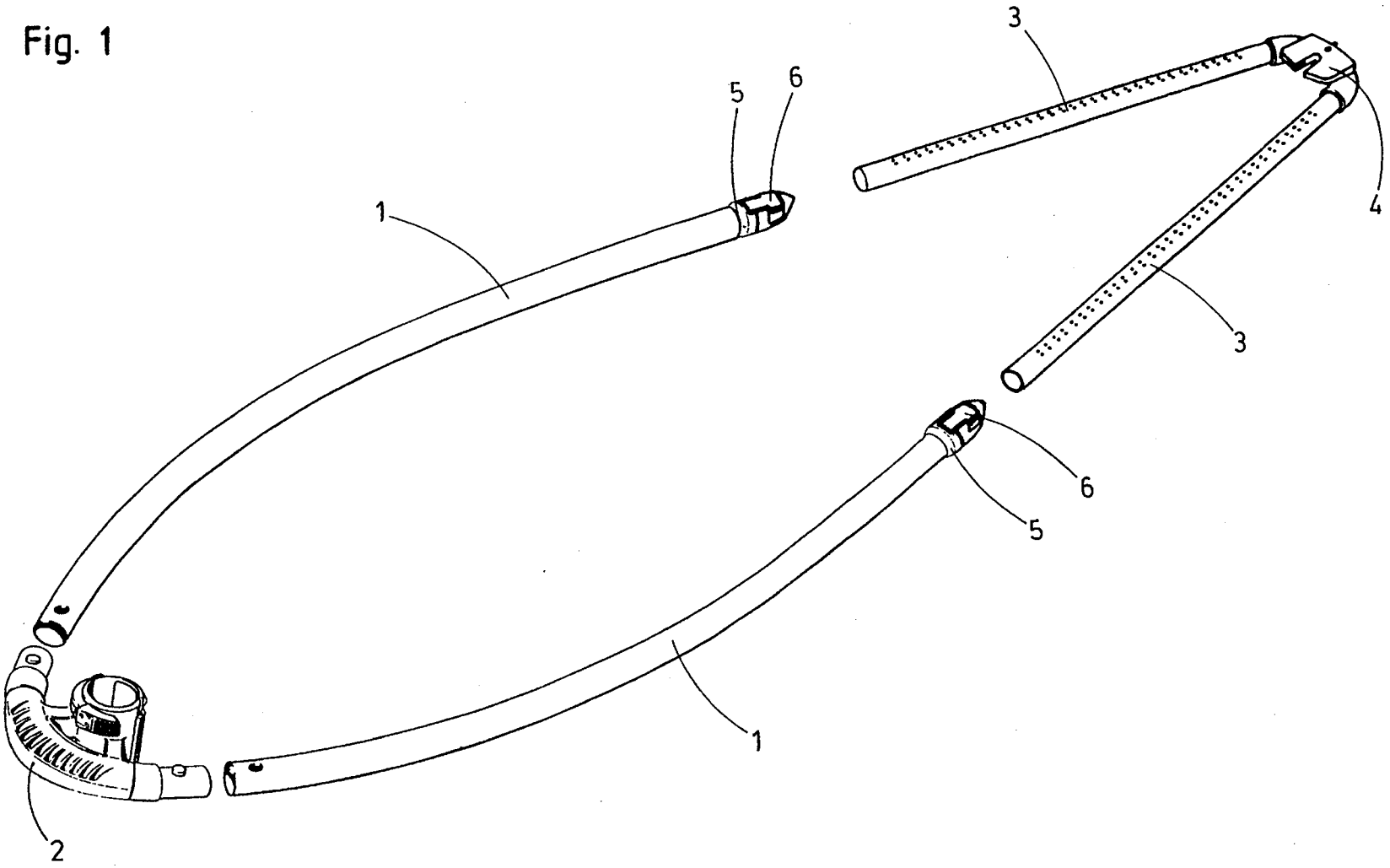
Figure 2:
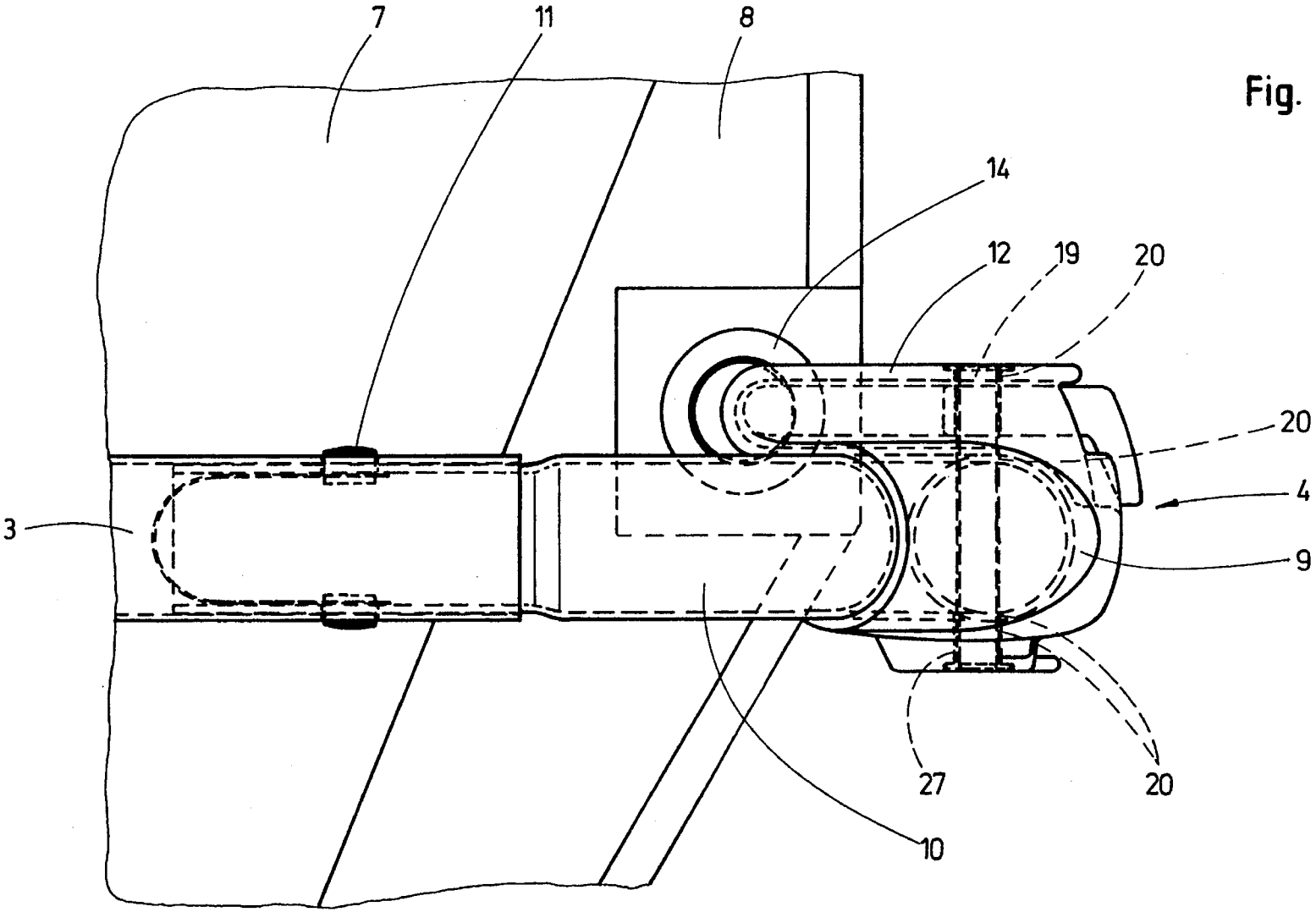
Figure 3:
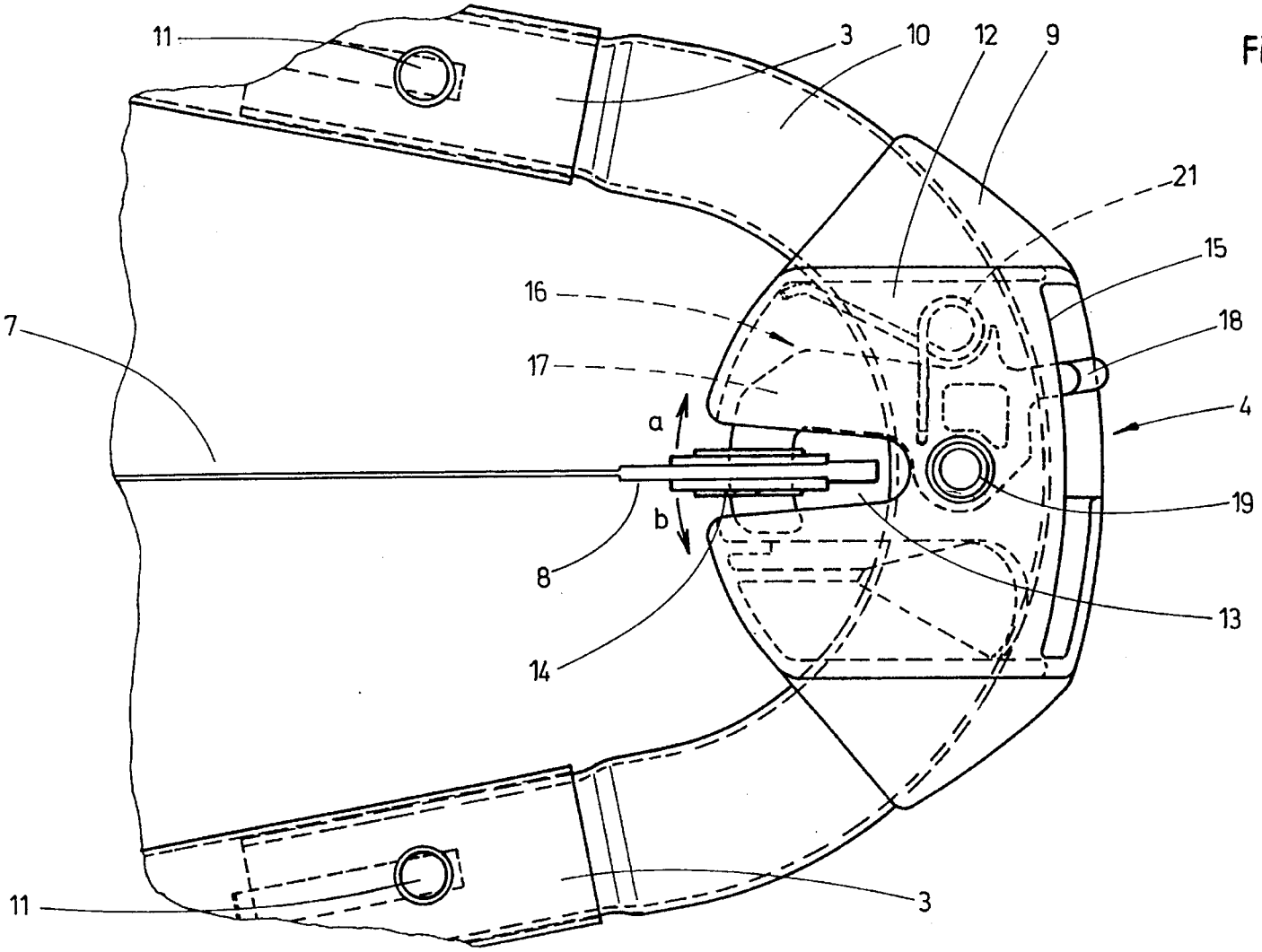
Figure 4:
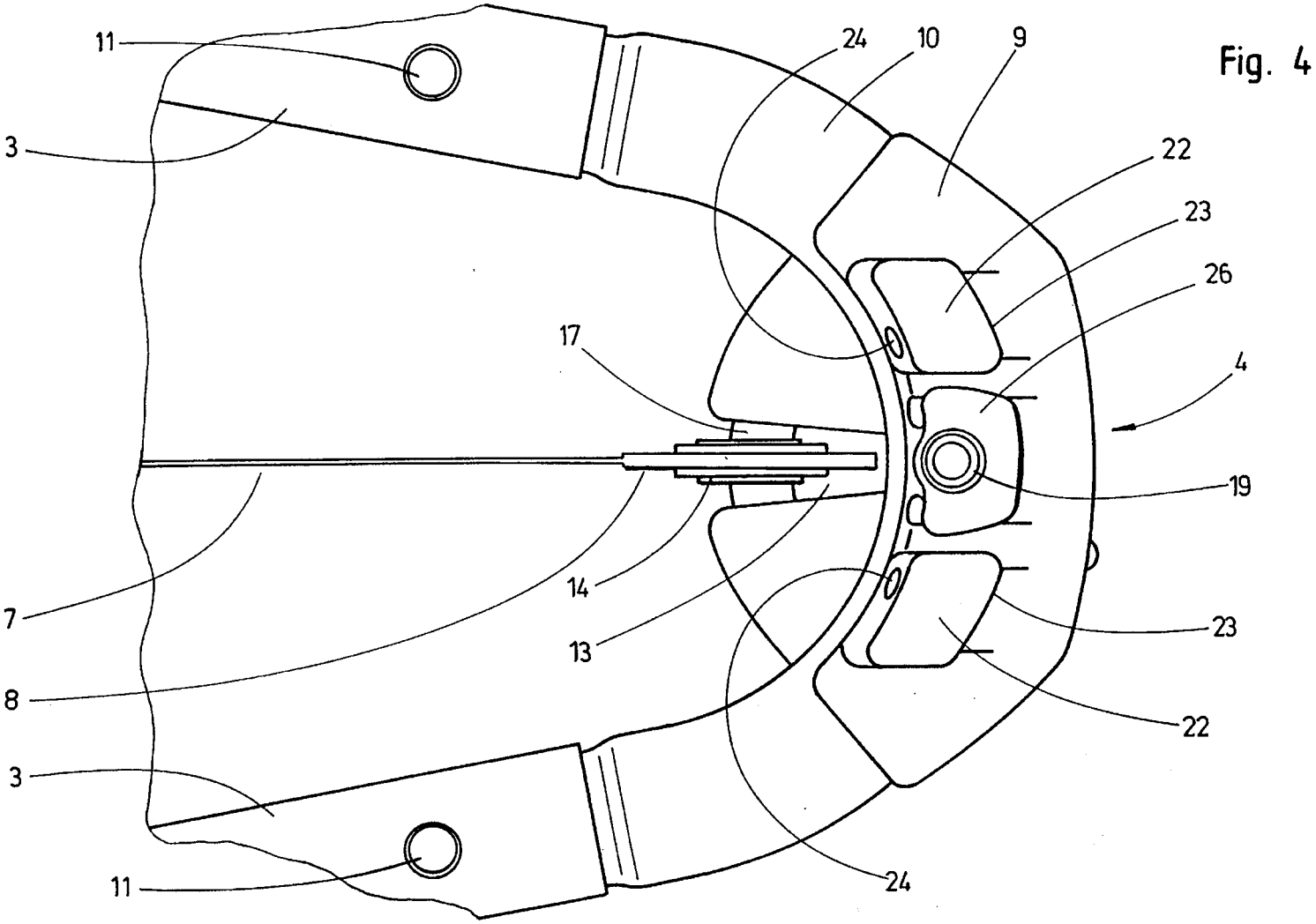

The forked boom endpiece according to the invention is explained via the following drawings:

FIG. 1: an exploded perspective view of a forked boom for the rig of a surfboard, FIG. 2: a side view of a clew of a sail fastened to the forked boom tailpiece, FIG. 3: a top view of the tailpiece, FIG. 4: a view of the tailpiece from below, FIG. 5: a longitudinal section, and FIG. 6: a front view of the tailpiece.

The forked boom of FIG. 1 consists essentially of two principal bars 1 that are bound together at an acute angle on the side of the mast through a forked boom head piece 2, two extension bars 3 that are bound together on the leech side through the forked boom tailpiece 4 and that telescope within the principal bars, and connecting bushes 5 with catch levers 6 to lock the extension bars 3 to the principal bars 1 at the length of the forked boom corresponding to the sail size. .

The forked boom is fastened to the forked boom head piece 2 at the mast of a surfboard and held together through the sail tension, which runs from the clew 8 of the sail 7 to the forked boom tailpiece 4.

The forked boom tailpiece 4 according to FIGS. 2 to 6 consists of a tube bend segment 9 produced as an injection-molded part made of synthetic material, which opens forwardly and is elastic to a certain extent, and is mounted oil an aluminum tube bend 10 which in turn is releasably connected to the extension bars 3 of the forked boom by spring-loaded latches 11.

On the upper side of the tube bend segment 9 is a flat plate 12 with a wide straight-through slit 13 to receive the clew 8 of the sail 7 formed with an inserted fastening ring 14. On the rearside of the segment 9 there is a mounting opening 15 for the installation of a spring-loaded latch 16 with a spring-urged swivelling hook 17 for swinging into and out of the clew ring 14.

The swivelling hook 17 of the spring-loaded latch 16 projects rearwardly with its hook-shaped actuating end 18 through the mounting opening 15 of the tube bend segment 9. The swivelling hook 17 is positioned so it can turn on a rivets 19 that also fastens the tube bend segment 9 to the tube bend 10. The compression rivet 19 extends through respective straight-through holes 20 of the plates 12, of the spring-loaded latch 16, of the tube bend segment 9, and of the tube bend 10.

Figure 5:
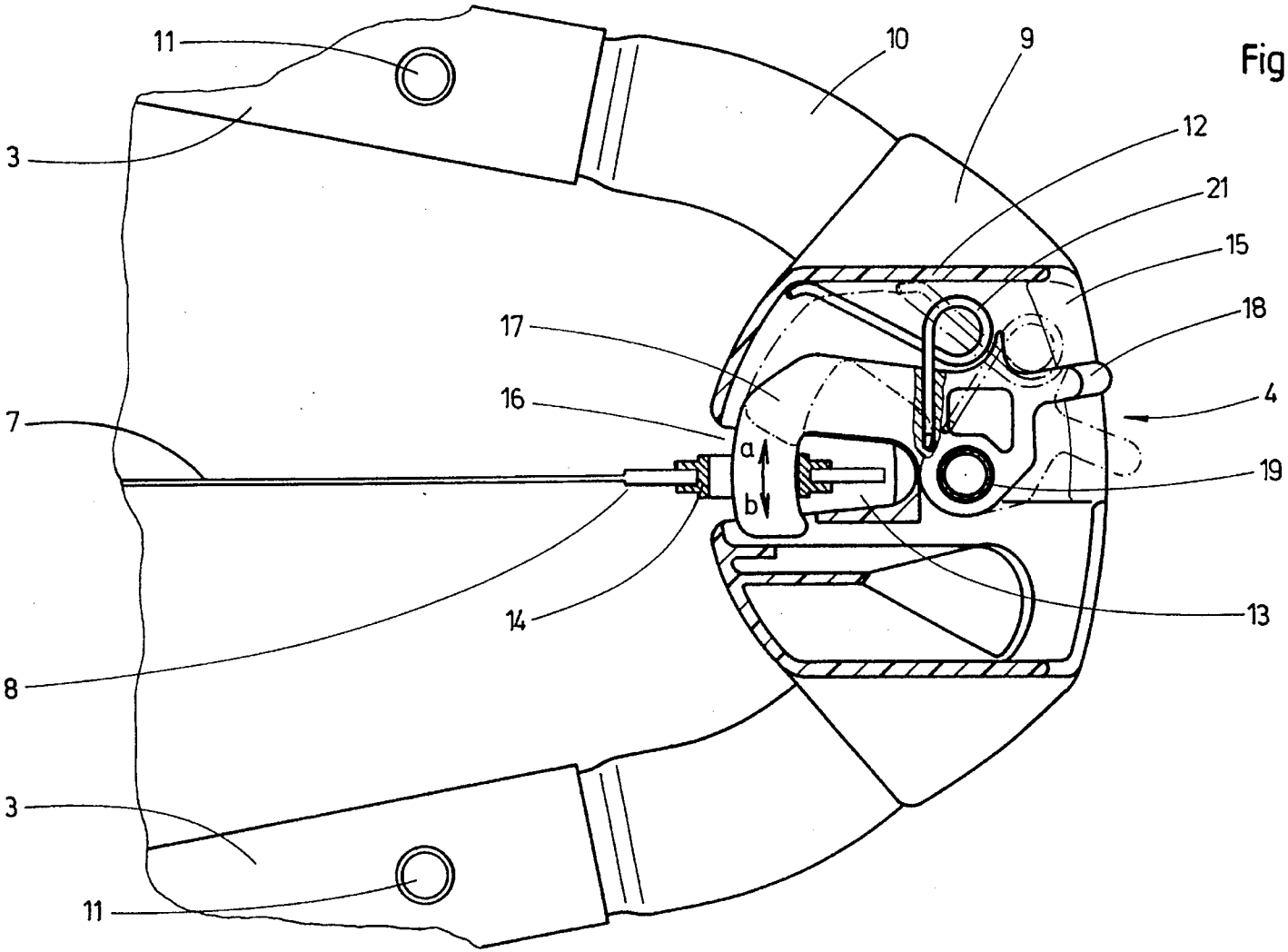
Figure 6:
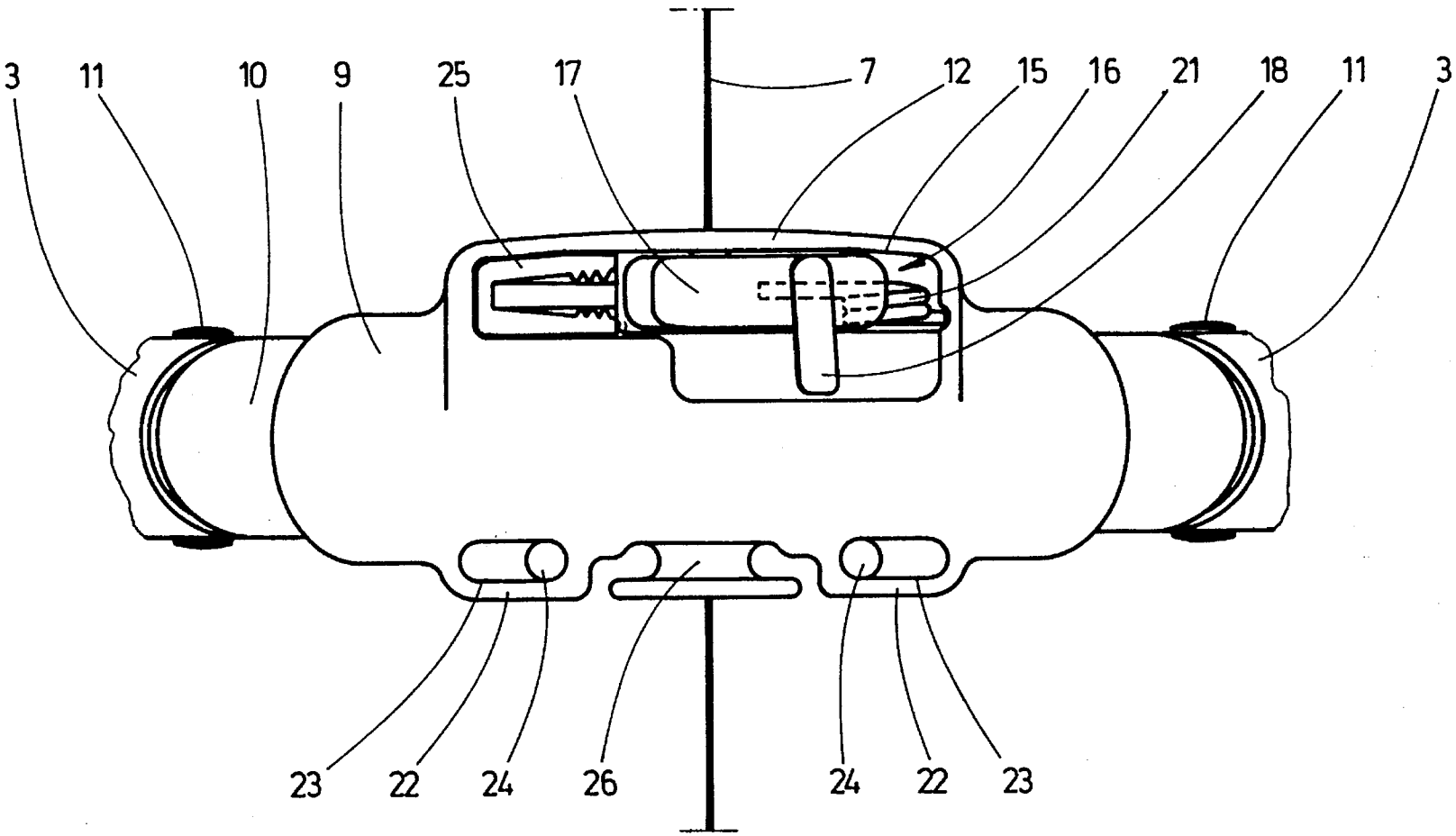

When opening the spring-loaded latch 16 the hook 17 swivels out of the clew ring 14 of the sail 7 in the direction of arrow a in FIG. 5 and at the same time the locking spring 21 acting on the swivelling hook 17 is stressed. To close the spring-loaded latch 16 a light touch of the finger on the actuating end 19 of the swivelling hook 17 suffices to snap it in, as a result of the spring force of the locking spring 21 in the direction of arrow b, into the clew ring 14 of the sail.

On the underside of the tube bend segment 9 projections 22 are, formed with a threading opening 23 and a through hole 24 for holding one end of a rope's end provided with a knot for fastening the clew 8 of a sail 7 in the traditional way are formed, and in the plate 12 of the tube bend segment 9 a belaying pin 25 to tighten the other end of the rope's end is positioned.

Between the holding projections 22 for a rope's end, for fastening on the underside of the tube bend segment 9, a reversing sockle 26 for the rope's end is formed, the reversing sockle 26 having a central straight-through bore 27 for the fastening rivet 19 of the tube bend segment 9.

Tube bend 10, swivelling hook 17, belaying pin 25, and fastening rivet 19 of the forked boom end piece 4 are made of aluminum.

I claim:

1. Tailpiece for a forked boom of a rig for surfboards, comprising a tube bend segment (9), carried by a tube bend (10) to which is fastened bars (3) of the forked boom, wherein on the upper side of the tube bend segment (9) there is a plate (12) with a wide straight-through slit (13) for receiving a fastening ring (14) of the clew (8) of the sail (7) the bend segment (9) having a rear opening (15), a spring-loaded latch (16) exposed through said opening (15), and a hook (17) on said latch (16) for swivelling in and out of the fastening ring (14) of the sail (7).

2. Tailpiece according to claim 1, wherein the swivelling hook (17) of the spring-loaded latch (16) has a hook-shaped actuating end (18) that projects rearward through said opening (15) of the tube bend segment (9), and a locking spring (21) acting on the latch (16), said spring (21) being tensioned when opening the spring-loaded latch (16).

3. Tailpiece according to claim 1, wherein the latch (16) rotates on a rivet (19) that fastens the tube bend segment (9) on the tube bend (10), wherein the rivet (19) extends through respective straight-through holes (20) of the plate (12), of the spring-loaded latch (16), of the tube bend segment (9), and of the tube bend (10).

4. Tailpiece according to claim 1, further comprising projections (22) formed on the underside of the tube bend segment (9) with an opening (23) and a through hole (24) to hold one end of a rope's end provided with a knot to fasten the clew (8) of a sail (7), as well as a belaying pin (25) positioned in the plate (12) of the tube bend segment (9) to tighten the rope's other end.

5. Tailpiece according to claim 1, further comprising a snubbing member (26) for the rope's end formed between the projections (22).

6. Tailpiece according to claim 5, wherein a rivet (19) on the tube bend segment (9) extends through a central bore (27) of the snubbing member (26).

7. Tailpiece according to claim 1, wherein the tube bend segment (9) is produced as an injection-molded part made of synthetic material.

8. Tailpiece according to claim 1, wherein the tube bend (10) and the hook (17) are made of aluminum.

* * * * *